United States Patent [19]

Herrington

[11] Patent Number: 5,007,142

[45] Date of Patent: Apr. 16, 1991

[54] METHOD OF ASSEMBLING A SNAPPED-TOGETHER MULTIPART PLASTIC SLIDER WITH A PLASTIC RECLOSABLE FASTENER

[75] Inventor: Fox J. Herrington, Holcomb, N.Y.

[73] Assignee: Mobil Oil Corp., Fairfax, Va.

[21] Appl. No.: 490,107

[22] Filed: Mar. 7, 1990

[51] Int. Cl.[5] ..... A44B 19/16

[52] U.S. Cl. ..... 24/400; 24/399; 24/587

[58] Field of Search ..... 24/400, 399, 587, 576; 383/63, 65; 156/66

[56] References Cited

U.S. PATENT DOCUMENTS

| | | | |
|---|---|---|---|
| 3,103,049 | 9/1963 | Hawley | 24/400 |
| 3,220,076 | 11/1965 | Ausnit et al. | 24/201 |
| 3,347,298 | 10/1967 | Ausnit et al. | 150/3 |
| 3,426,396 | 2/1969 | Laguerre | 24/201 |
| 3,462,332 | 8/1969 | Goto | 156/244 |
| 3,579,747 | 5/1971 | Hawley | 24/400 |
| 3,660,875 | 5/1972 | Gutman | 24/201 |
| 3,713,923 | 1/1973 | Laguerre | 156/66 |
| 3,790,992 | 2/1974 | Herz | 24/201 |
| 3,806,998 | 4/1974 | Laguerre | 24/201 |
| 4,262,395 | 4/1981 | Kosky | 24/400 |
| 4,736,451 | 4/1988 | Ausnit . | |

FOREIGN PATENT DOCUMENTS

| | | | |
|---|---|---|---|
| 513784 | 6/1957 | Italy | 24/400 |
| 914203 | 12/1962 | United Kingdom | 24/400 |
| 914204 | 12/1962 | United Kingdom | 24/400 |

*Primary Examiner*—Victor N. Sakran

*Attorney, Agent, or Firm*—Alexander J. McKillop; Charles J. Speciale

[57] ABSTRACT

A method of assembling a snapped-together multipart plastic slider with a plastic reclosable fastener on plastic bags is disclosed. The multipart plastic slider includes a separator finger and two side walls mechanically snapped together in place on the plastic bags.

12 Claims, 4 Drawing Sheets

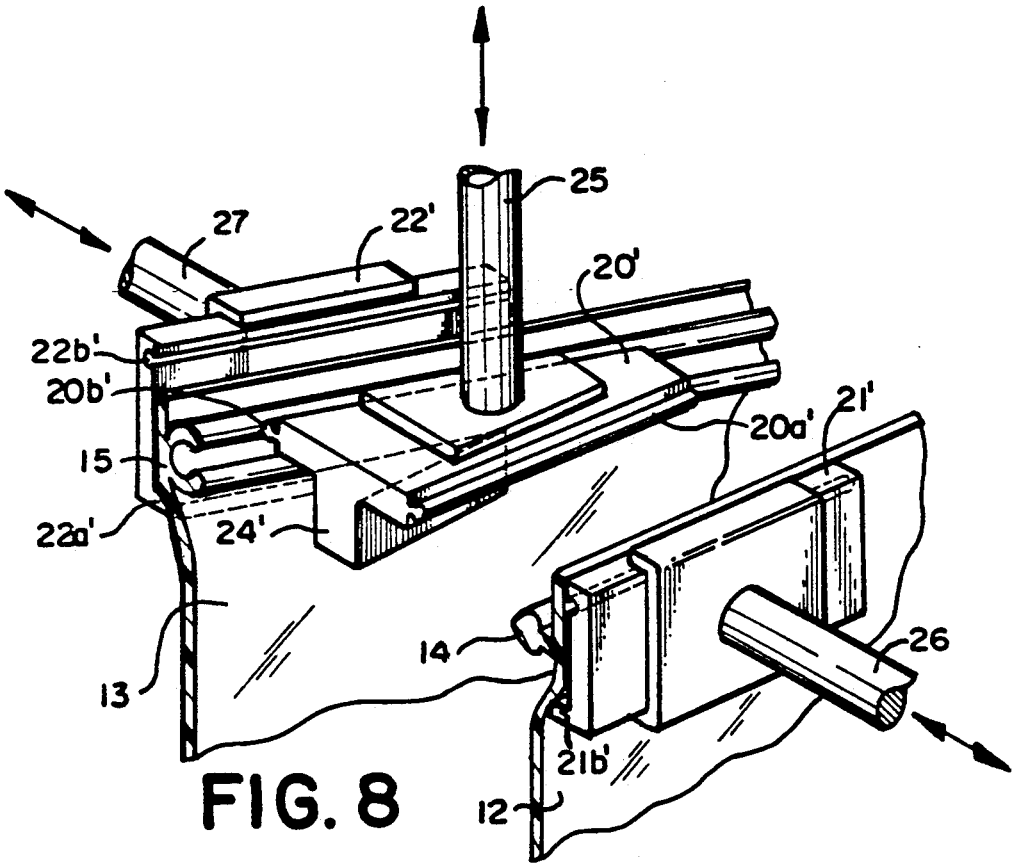
FIG. 8
FIG.8a
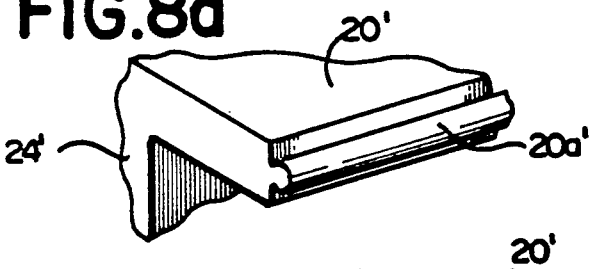
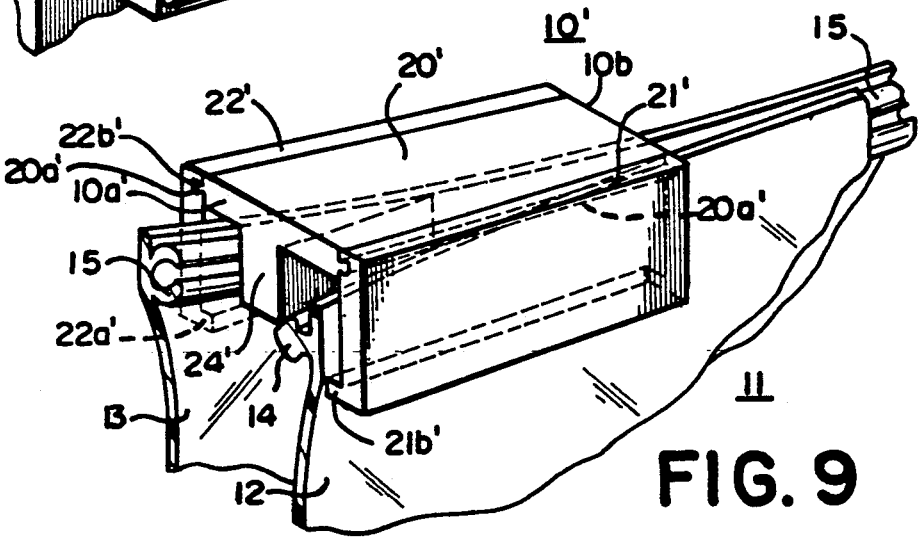
FIG. 9

METHOD OF ASSEMBLING A SNAPPED-TOGETHER MULTIPART PLASTIC SLIDER WITH A PLASTIC RECLOSABLE FASTENER

BACKGROUND OF THE INVENTION

The present invention relates to improvements in plastic sliders for opening and closing plastic reclosable fasteners on plastic bags and the like and the method of assembling a snapped-together multipart plastic slider with a profiled plastic reclosable fastener on the plastic bags.

Zippers with sliders are made commercially in several forms. The most common ones used on clothing have teeth which interlock. The teeth may be made of metal or plastic. Other types of plastic zippers have profiles that include a pair of male and female fastener elements in the form of reclosable interlocking rib and groove elements with a slider for opening or closing the rib and groove elements. In the manufacture of thermoplastic film bags, a pair of these male and female fastener elements extend along the mouth of the bag and these male and female elements are adapted to be secured in any suitable manner to the flexible walls of the thermoplastic film bag. These elements may be integral marginal portions of such walls or they may be extruded separately and thereafter attached to the wall along the mouth of the bag. A method of continuously providing such a fastener on the thermoplastic film is disclosed in U.S. Pat. No. 3,462,332.

The sliders for opening or closing the reclosable fasteners are essentially U-shaped and adapted to be assembled with the fastener or zipper by an endwise assembly or by a relative transverse maneuver. Where the assembly is performed by a relative transverse maneuver the slider is normally molded from a semi-hard plastic where there is enough yieldability in the side walls of the slider to provide sufficient flexibility to enable spreading apart of the terminal portions of the side walls of the slider so as to clear the interlocking rib and groove elements to permit assembly of the slider with the zipper by relative transverse movement. Where the slider is formed from a metal die casting or a hard plastic, it has been necessary to rely upon the elastic deformation of the plastic zipper elements to permit the transverse assembly movement of the slider. Such assembly can cause damage to the interlocking rib and groove elements during assembly and leaves something to be desired. Examples of assembly of sliders with plastic reclosable fasteners are disclosed in U.S. Pat. Nos. 3,426,396, 3,660,875, 3,713,923, 3,790,992 and 3,806,998.

RELATED APPLICATIONS

A method of assembling a metal slider with a plastic reclosable fastener is disclosed in my related application entitled "Method of Assembling Metal Slider with a Plastic Reclosable Fastener" Ser. No. 490,114 filed concurrently herewith and incorporated herein by reference thereto. A method of assembling a multipart plastic slider with a plastic reclosable fastener is disclosed in my related application entitled "Method of Assembling a Multipart Plastic Slider with a Plastic Reclosable Fastener by Ultrasonic Welding" Ser. No. 490,109 filed concurrently herewith and incorporated herein by reference thereto.

SUMMARY OF THE INVENTION

It is an object of the present invention to provide a new and improved snapped-together multipart plastic zipper slider and method of assembling the same with a profiled plastic reclosable fastener without deforming the fastener during assembly of the slider therewith.

The present invention relates to a multipart plastic slider for a profiled plastic reclosable fastener particularly suited for thermoplastic bags and the like formed by a pair of flexible plastic sheets each having a top edge with separable fastener means extending along the length thereof comprising reclosable interlocking rib and groove profile elements on the respective sheets. A straddling slider for closing or opening the reclosable fastener elements is provided comprising a plastic support member for moving along the top edges of the fastener elements having interlocking structure on the sides thereof to support depending side walls extending from an opening end of the slider to a closing end, the side walls being spaced wider apart at the opening end to permit separation of the rib and groove elements and being spaced sufficiently close together at the closing end to press the rib and groove elements into interlocking relationship as the slider is moved in a fastener closing direction. A depending plastic separator finger is provided on the support member of the slider extending between the side walls of the opening end for separating the rib and groove elements as the slider is moved in a fastener opening direction, the separator finger being of wedge-shaped construction with the wider end of the wedge at the opening end. Shoulder structure is provided on the bottom of the separator finger and/or the bottom of the side walls for cooperating with the bottom of the fastener for preventing the slider from being lifted off the top edge of the fastener while the slider straddles the fastener.

In one form of the invention, the depending side walls are pressed onto pin structure on the support member which comprises pins having barbs so that once they are inserted into holes in the side walls they interlock and will not come out. In another form of the invention the interlocking structure for the support member and side wall is formed by rib and groove structure. In accordance with the method of the present invention a stream of plastic bags with a zipper profile along its front and back faces moves along a production line. The plastic separator finger is inserted between the passing zippers until the support member rests on the top edges of the bag, then the side walls of the slider are moved toward the separator finger and snapped in place by the interlocking structure, making a permanently-assembled plastic slider.

Other objects and advantages of the invention will become apparent from the following detailed description of the invention taken in conjunction with the accompanying drawings.

BRIEF DESCRIPTION OF THE DRAWINGS

FIG. 8 is an exploded view illustrating the method of assembling a modified multipart plastic slider with the profiled plastic reclosable fastener in accordance with the present invention.

FIG. 8*a* is an enlarged view of the interlocking rib and groove shown in FIG. 8.

FIG. 9 is a perspective view of the modified snapped-together multipart plastic slider assembled according to FIG. 8.

PREFERRED EMBODIMENT OF THE INVENTION

Figure 1:
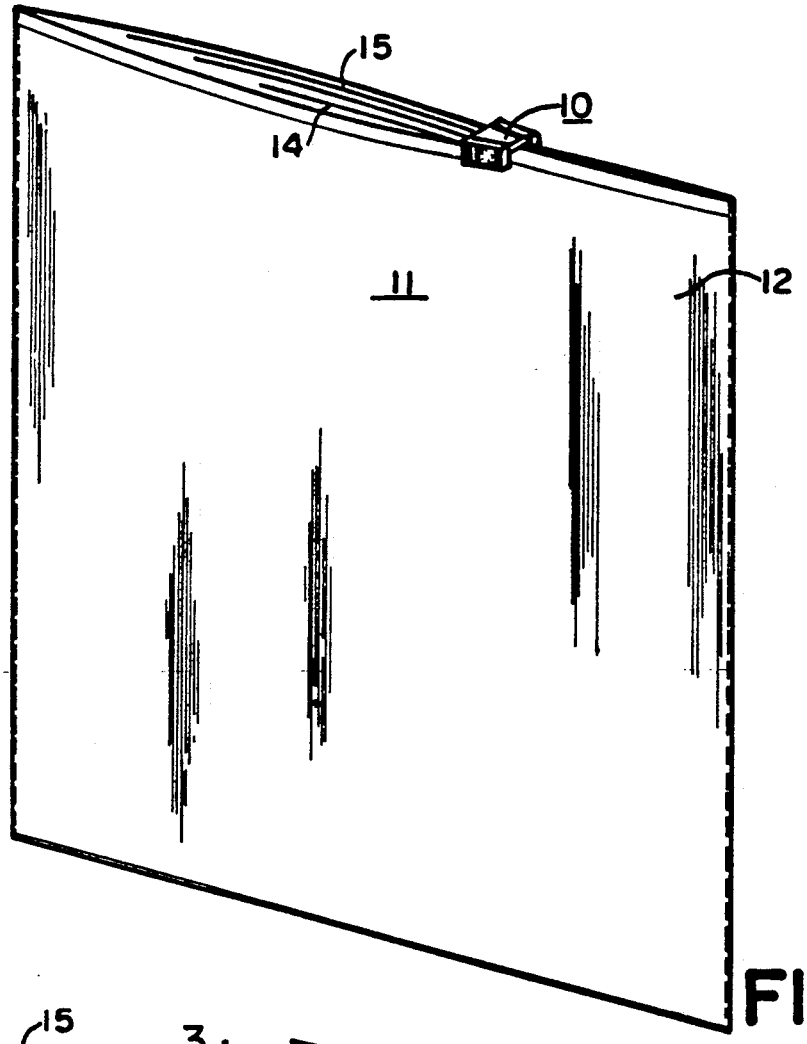
FIG. 1 is a perspective view of a thermoplastic bag or the like having a snapped-together multipart plastic slider embodying the present invention assembled on the separable fastener means at the top edge of the bag in accordance with method embodying the present invention.
Figure 5:
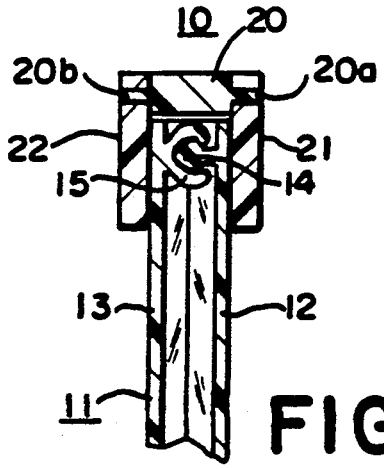
FIG. 5 a sectional view taken along the lines 5—5 in FIG. 2.

Referring to FIG. 1, there is illustrated a snapped-together multipart plastic slider 10 for a profiled plastic reclosable fastener embodying the present invention. The slider 10 is particularly suited for thermoplastic bags and the like and has been illustrated in FIG. 1 in connection with a thermoplastic bag 11. The bag 11 may be made from any suitable thermoplastic film such for example as polyethylene or polypropylene or equivalent material. The bag 11 is formed by a pair of flexible plastic sheets 12 and 13 having a top edge With separable fastener means or zipper at the top edge extending along the length thereof having reclosable interlocking rib and groove profile elements 14 and 15 on the facing surfaces thereof. As pointed out above, in the manufacture of thermoplastic film bags, the pair of male and female fastener elements 14 and 15 extend along the mouth of the bag and these zipper (interlocking rib and groove profiles) elements are adapted to be secured in any suitable manner to the flexible walls of the thermoplastic film bag. These elements may be integral marginal portions of such walls or they may be extruded separately and thereafter attached to the walls along the mouth of the bag as well known in the art. The elements 14 and 15 are attached to the respective walls of the bag on opposite sides of the bag as disclosed in FIGS. 3–8. The manner of attaching these elements to the respective walls of the bag is well known in the art and does not form part of the present invention. As may be seen in FIGS. 1, 2 and 7 the slider 10 straddles the reclosable fastener elements at the top of the bag 11 and is adapted for opening or closing the reclosable fastener elements. The slider 10 is formed from multiple plastic parts comprising a separator finger and complimentary structure. The plastic parts are molded from a suitable plastic such for example as nylon, polypropylene, polystyrene, Delrin or ABS. In the preferred embodiment the complimentary structure comprises a plastic support member 20 for moving along the top edges of the fastener elements with depending side walls 21 and 22 supported thereon as hereinafter described and extending from an opening end 10*a* of the slider to a closing end 10*b*. As may be seen in FIGS. 2–5 the side walls 20 and 21 are spaced wider apart at the opening end 10*a* of the slider 10 to permit separation of the rib and groove elements 14 and 15 and are spaced sufficiently close together at the closing end 10*b* of the slider to press the rib and groove elements 14 and 15 into interlocking relationship, FIG. 5, as the slider 10 is moved in a fastener closing direction.

Figure 2:
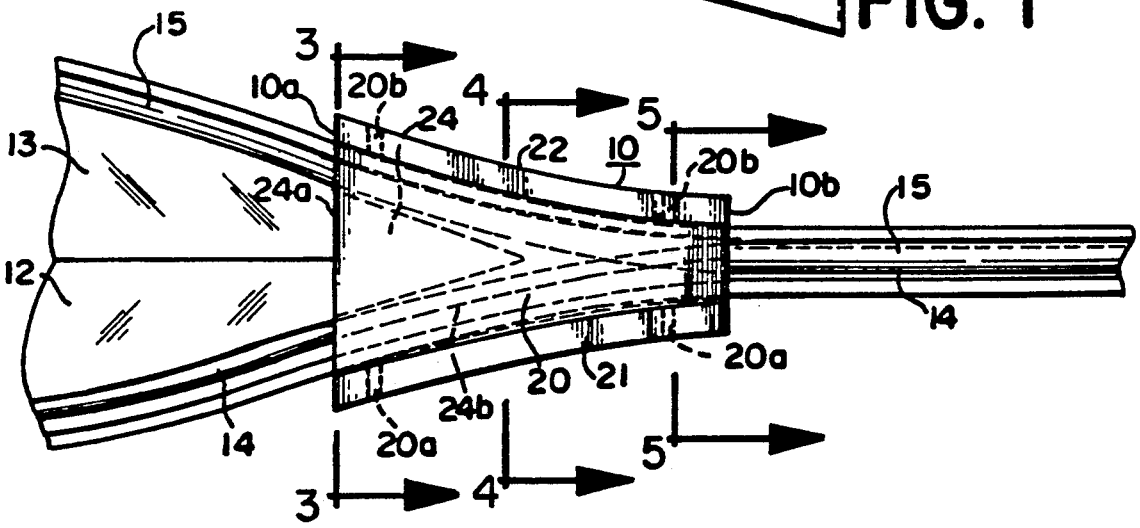
FIG. 2 is a fractional top plan view on enlarged scale of the slider shown in FIG. 1.
Figure 3:
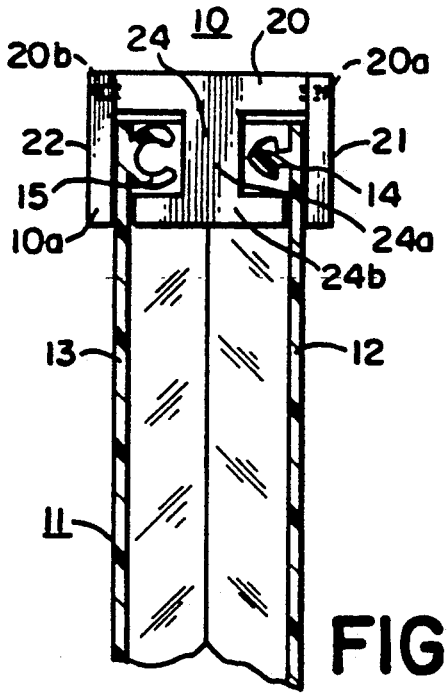
FIG. 3 is a sectional view taken along the lines 3—3 in FIG. 2.
Figure 4:
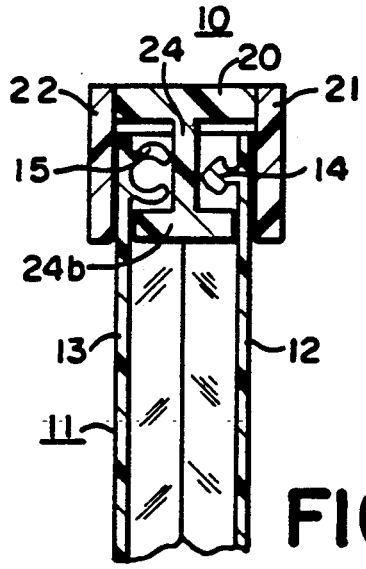
FIG. 4 is a sectional view taken along the lines 4—4 in FIG. 2.

The slider 10 is provided with a depending plastic separator finger 24 which extends between the side walls 21 and 22 at the opening end 10*a* of the slider 10 for separating the rib and groove elements 14 and 15 as the slider 10 is moved in a fastener opening directions, FIG. 2 and 3. As may be seen in FIGS. 2–4, the separating finger 24 is of wedge-shaped construction with the wider end 24*a* of the wedge 24 at the opening end 10*a* of the slider 10. The separating finger is provided at its lower end with outwardly extending shoulder structure 24*b*, FIGS. 2–4 for engaging the bottom of the fastener comprising the rib and groove elements 14 and 15 to prevent the slider 10 from being lifted off the top edge of the fastener while the slider straddles the fastener as shown in FIGS. 1–3.

Figure 6:
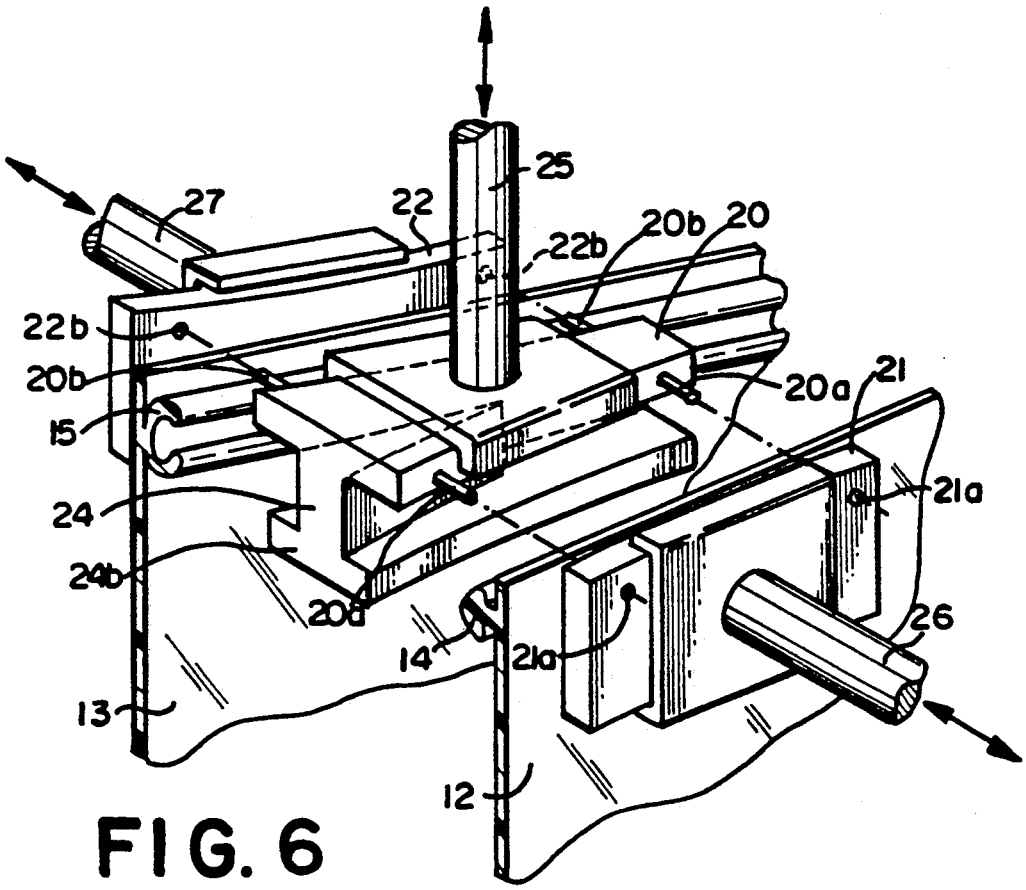
FIG. 6 is an exploded view illustrating the method of assembling the multipart plastic slider of FIGS. 1 and 2 with the profiled plastic reclosable fastener in accordance with the present invention.
Figure 6A:
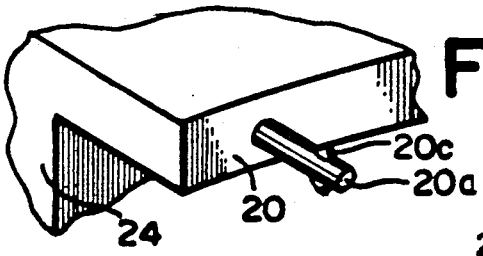
FIG. 6*a* is an enlarged fractional view of the one of the interlocking pins shown in FIG. 6.
Figure 7:
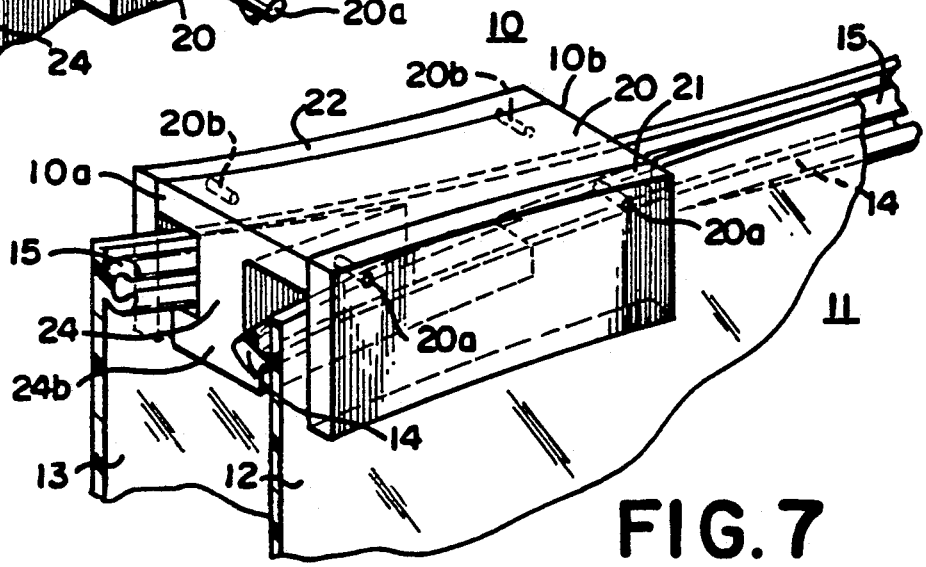
FIG. 7 a perspective view of the snapped-together multipart plastic slider assembled according to FIG. 6.

Referring to FIGS. 6–7 there is illustrated the method of assembling the multipart plastic slider 10 with the profiled plastic reclosable fastener of a thermoplastic bag formed by the pair of flexible plastic sheets 12 and 13 having a top edge with separable fastener means at the top edge extending along the length thereof having reclosable interlocking rib and groove profile elements 14 and 15 on the facing surfaces thereof. The interlocking rib and groove profile elements 14 and 15 on the facing surfaces are placed in alignment so that they can be joined as indicated at the right hand end of FIG. 2. The wedge-shaped separator finger 24 is integral with the support member 20 and the shoulder structure 24*b* to form an I-shaped section. It will be noted that the support member 20 has projecting from the opposite edges thereof a pair of pins 20*a* and a section pair of pins 20*b*. The pins 20*a* and 20*b* are plastic and preferably are molded as integral parts with the member 20. The pins 20*a* are adapted to be received in the pair of openings 21*a* in the depending side wall 21 and the pins 20*b* are adapted to be received in the pair of openings 22*b* in the side wall 22, FIG. 6. The pins 20*a* and 20*b* preferably have interlocking structure such as barbs 20*c* so that once the pins are inserted into the corresponding holes they will not: come out. An example of the interlocking structure 20*c* is shown in the enlarged fractional view, FIG. 6*a*.

As may be seen in FIG. 6 the plastic support member 20 is supported from above by a support plunger 25. The support 25 is adapted to be raised or lowered by any suitable means so that the separator finger 24 is positioned between the rib and groove profile elements 14 and 15 with the shoulder structure 24*b* on the bottom of the finger aligned to engage the bottom of the fastener and the bottom of the support member 20 aligned with the top edge of the bag structure. The side walls 21 and 22 are carried by any suitable means such for example as the plungers 26 and 27 as illustrated in FIG. 6. The side walls 21 and 22 are supported so that the holes 21*a* and 22*b* therein align respectively with the pins 20*a* and 20*b* in member 20. The plungers 26 and 27 are actuated by any suitable means to move the side walls 21 and 22 toward each other to cause the pins 20*a* to be inserted in the holes 21*a* in side wall 21 and the pins 20*b* to be inserted in the holes 22*b* in the side wall 22. By this action the side walls 21 and 22 are snapped together with the center support member 20 and the rib and groove profile elements 14 and 15 are pressed together so that the profiles are interlocked at the location adjacent the closing end 10*b* of the slider and against the sides of the wedged-shaped separator finger 24. At this time the side walls 21 and 22 are snapped in place on the pins 20*a*, 20*b* against the side edges of the support member 20 as shown in FIG. 7. The plungers 25, 26 and 27 are withdrawn so that the slider 10 is assembled with the profiled plastic reclosable fastener on the bag 11 as illustrated in FIG. 7.

Referring to FIGS. 8–9 there is illustrated the method of assembling a modified multipart plastic slider 10' with the profiled plastic reclosable fastener of a thermoplastic bag formed by the pair of flexible plastic sheets 12 and 13 having a top edge with separable fastener means at the top edge extending along the length thereof having reclosable interlocking rib and groove profile elements 14 and 15 on the facing surfaces thereof. The interlocking rib and groove profile elements 14 and 15 on the facing surfaces are placed in alignment so that they can be joined as indicated at the right hand end of FIG. 9. The support member 20' and the shoulder structure 24*a* in FIG. 7 is omitted to form a T-shaped section and added to the side walls 21' and 22' at the bottom thereof as shoulders 21*b'* and 22*a'*. It will be noted that the support member 20 has projecting from the opposite edges thereof male rib structure 20*a'* and 20*b'*. The ribs 20*a'* and 20*b'* are plastic and preferably are molded as integral parts with the member 20'. The rib 20*a'* is adapted to be received in the female grooves 21*a'* in the depending side wall 21' and the rib 20*b'* is adapted to be received in the female groove 22*b'* in the side wall 22', FIG. 8. The ribs 20*a'* and 20*b'* interlock with the female grooves 21*a'* and 22*b'* so that once the ribs are inserted into the corresponding grooves they will not come out. An enlargement of the interlocking structure is shown in the enlarged fractional view, FIG. 8*a*.

As may be seen in FIG. 8 the plastic support member 20' is supported from above by vacuum through a support plunger 25. The support 25 is adapted to be raised or lowered by any suitable means so that the separator finger 24 is positioned between the rib and groove profile elements 14 and 15 with the support member 20' aligned with the top edge of the bag structure. The side walls 21' and 22' are carried by any suitable means such for example as the plungers 26 and 27 as illustrated in FIG. 8, which may have a vacuum connection. The side walls 21' and 22' are supported so that the grooves 21*a'* and 22*b'* therein align respectively with the ribs 20*a'* and 20*b'* in member 20'. The plungers 26 and 27 are actuated by any suitable means to move the side walls 21' and 22' toward each other to cause the ribs 20*a'* to be inserted in the grooves 21*a'* in side wall 21 and the ribs 20*b'* to be inserted in the groove 22*b'* in the side wall 22'. By this action the side walls 21' and 22' are snapped together with the center support member 20' and the rib and groove profile elements 14 and 15 are pressed together so that the profiles are interlocked at the location adjacent the closing end 10*b'* of the slider and against the sides of the wedged-shaped separator finger 24'. At this time the side walls 21' and 22' are snapped in place on the ribs 20*a'*, 20*b'* against the side edges of the support member 20' as shown in FIG. 9. The shoulders 21*b'* and 22*a'* are positioned beneath the bottom of the fastener elements 14 and 15 to prevent the slider 10' from being lifted off the top edge of the fastener. The plungers 25, 26 and 27 are withdrawn so that the slider 10' is assembled with the profiled plastic reclosable fastener on the bag 11' as illustrated in FIG. 9. While the shoulder 24*b* at the bottom of finger 24' has been omitted in FIGS. 8 and 9, it can be added to assist the shoulders 21*b'* and 22*a'* in keeping the slider 10' on the fastener.

By making the sliders 10 and 10' of multiple plastic parts, the sliders can be readily assembled in a transverse direction with the rib and groove profile elements by inserting the fingers 24 or 24' between the rib and groove profile elements and then snapping together the side walls 21 and 22 or 21' and 22' for the center support member 20 or 20' while the slider engages the top edge of the bag. This is accomplished without deforming the rib and groove elements of the fastener thereby eliminating any possible damage to these elements and also enables the assembly of the slider with the elements of the fastener to be accomplished quickly and insures that the assembly is accomplished properly.

The method of assembly disclosed herein is particularly suited for the manufacture of thermoplastic bags on a production line where the bags move sequentially along the production line. The multipart plastic sliders 10 or 10' may be assembled with the bags prior to the formation of the side seals or after the formation of the side seals and severing of the individual bags as desired. In any event the multipart plastic slider is assembled with the reclosable fastener structure at periodic intervals along the plastic profiles with one fastener for each bag to be manufactured.

While a preferred embodiment of the invention has been described and illustrated, it is to be understood that further modifications thereof may be made within the scope of the appended claims without departing from the spirit of the invention.

What we claim is:

1. The method of assembly of a multipart plastic slider in straddling relation with a profiled plastic reclosable fastener particularly suited for thermoplastic bags and the like formed by a pair of flexible plastic sheets each having a top edge with separable fastener means extending along the length thereof comprising reclosable interlocking rib and groove profile elements on the respective sheets, the straddling slider for closing or opening the reclosable fastener elements comprising a wedge-shaped separator finger and interlocking complimentary structure formed from plastic for moving along the fastener, the complimentary structure including depending side walls extending from an opening end of the slider to a closing end, the side walls being spaced wider apart at the opening end to permit separation of the rib and groove elements by the wedge-shaped separator finger extending between the side walls at the opening end, the side walls being spaced sufficiently close together at the closing end to press the rib and groove elements into interlocking relationship as the slider is moved in a fastener closing direction, at least one of the separator finger and the side walls having shoulder structure on the bottom thereof for cooperating with the bottom of the fastener, the method comprising the steps of placing the interlocking rib and groove profile elements on the facing surfaces in alignment so that they can be joined, supporting the wedge-shaped separator finger between the rib and groove profile elements, pressing the rib and groove profile elements together so that the profiles are interlocked at the location adjacent the closing end of the slider and against the sides of the wedge-shaped separator finger, positioning the side walls of the complimentary structure of the slider for assembly with the top end of the separator finger, and pressing the side walls of the complimentary structure of the slider in a direction transversely of the separator finger and the rib and groove profile elements until the side walls straddle the rib and groove profile elements of the fastener and engage and automatically interlock with the separator finger so that the shoulder structure on the bottom of at least one of the wedge-shaped separator finger and the side walls cooperates with the bottom of at least one of the rib and groove profile elements to prevent the slider from being lifted off the top edge of the fastener while the slider straddles the fastener.

2. The method according to claim 1 wherein the separator finger includes an I-shaped section and the complimentary structure comprises a pair of side walls mechanically interlocked with the top edges of the I-shaped section.

3. The method according to claim 1 wherein the separator finger includes a T-shaped section and the complimentary structure comprises a pair of side walls mechanically interlocked with the top edges of the T-shaped section and having shoulder structure in the bottom of the side walls.

4. The method of assembly of a multipart plastic slider comprising a separator finger and complimentary structure, with a profiled plastic reclosable fastener particularly suited for thermoplastic bags for opening and closing the fastener comprising:

positioning a plastic bag having a plastic reclosable fastener along the top edges of the front and back faces of the bag to receive the multipart plastic slider in straddling relation, the fastener having a female fastener profile attached to one of the faces of the bag and a male fastener profile attached to the other face of the bag, inserting the plastic separator finger between the male and female profiles, and forming the slider in straddling relation around the male and female fastener profiles at the top edges of the bag by snapping together the plastic separator finger and the complimentary structure automatically to form the multiple parts into a unitary slider whereby movement of the slider in one direction opens the fastener and movement in the opposite direction recloses the fastener.

5. The method according to claim 4 wherein the separator finger includes a T-shaped section and the complimentary structures comprises a pair of side walls connected to the top edges of the T-shaped section.

6. The method according to claim 4 wherein the separator finger includes a wedge-shaped portion and a bottom member on the wedge-shaped portion and engaging the bottom of the male and female fastener profiles.

7. The method according to claim 6 wherein the separator finger includes an I-shaped section and the complimentary structure comprises a pair of side walls mechanically connected to the top edges of the I-shaped section.

8. The method according to claim 7 wherein the top edges of the I-shaped section have projecting structure for insertion in cooperating female structures in the pair of side walls.

9. The method according to claim 8 wherein the projecting structures comprises pins having barb structure for interlocking with openings in the pair of side walls.

10. A multipart plastic slider for straddling relation with a profiled plastic reclosable fastener particularly suited for thermoplastic bags and the like formed by a pair of flexible plastic sheets having a top edge with separable fastener means extending along the length thereof comprising reclosable interlocking rib and groove profile elements on the respective sheets, the straddling slider for closing or opening the reclosable fastener elements comprising a wedge-shaped separator finger and interlocking complimentary structure formed from plastic for moving along the fastener, the complimentary structure comprising a transverse support member having the wedge-shaped separator finger depending therefrom, said support member having interlocking structure on the opposite sides thereof, a pair of spaced depending side walls supported on said support member for engaging and automatically interlocking with said interlocking structure, said depending side walls extending from an opening end of the slider to a closing end, the side walls being spaced wider apart at the opening end to permit separation of the rib and groove elements by the wedge-shaped separator finger extending between the side walls at the opening end, the side walls being space sufficiently close together at the closing end to press the rib and groove elements into interlocking relationship as the slider is moved in a fastener closing direction, at least one of said separator finger and said side walls having shoulder structure on the bottom thereof for cooperating with the bottom of the fastener to prevent the slider from being lifted off the top edge of the fastener while the slider straddles the fastener.

11. A multipart plastic slider according to claim 10 wherein said interlocking structure includes interlocking rib and groove structure on said support member and said pair of side walls, to automatically interlock said side walls with said support member.

12. A multipart plastic slider according to claim 10 wherein said interlocking structure includes pin structure and cooperating openings on said support member and said side walls, to automatically interlock said side walls with said support member.

* * * * *